US007731511B2

(12) United States Patent
Craig

(10) Patent No.: US 7,731,511 B2
(45) Date of Patent: Jun. 8, 2010

(54) PANEL MOUNTED POWER MODULE

(75) Inventor: Evan Lawrence Craig, Vernon Hills, IL (US)

(73) Assignee: Tyco Electronics Corporation, Middletown, PA (US)

( * ) Notice: Subject to any disclaimer, the term of this patent is extended or adjusted under 35 U.S.C. 154(b) by 125 days.

(21) Appl. No.: 11/879,446

(22) Filed: Jul. 17, 2007

(65) Prior Publication Data

US 2009/0023341 A1 Jan. 22, 2009

(51) Int. Cl.
*H01R 4/66* (2006.01)

(52) U.S. Cl. ..... 439/95; 439/607.28; 439/939

(58) Field of Classification Search ..... 439/95, 439/92, 106, 562, 607, 939
See application file for complete search history.

(56) References Cited

U.S. PATENT DOCUMENTS 5,348,484 A * 9/1994 Sorrentino ..... 439/101
5,863,222 A * 1/1999 Kinsey et al. ..... 439/607
6,066,001 A * 5/2000 Liptak et al. ..... 439/607
6,135,794 A * 10/2000 Kwon et al. ..... 439/98
6,183,300 B1 * 2/2001 Belopolsky et al. ..... 439/607.4
6,997,723 B2 * 2/2006 Lee ..... 439/92
7,210,946 B2 * 5/2007 Chen ..... 439/92
7,219,404 B2 * 5/2007 Haga et al. ..... 24/458
7,229,298 B2 * 6/2007 Shen et al. ..... 439/95
2005/0026501 A1 * 2/2005 Zhan et al. ..... 439/607

* cited by examiner

*Primary Examiner*—Hien Vu

(57) ABSTRACT

A panel mounted power module is disclosed having an insulating housing and a conductive jacket. The insulating housing and the conductive jacket have corresponding flanges which oppose each other and are profiled to trap therebetween a panel. The power module includes a spring positioned between the insulating housing and conductive jacket, to spring load the flanges towards each other. The power module has at least one ground terminal and the spring commons the ground terminal and the conductive jacket together.

20 Claims, 8 Drawing Sheets

PANEL MOUNTED POWER MODULE

FIELD OF THE INVENTION

The subject invention relates to a jacketed power module that is attachable to an equipment panel. The power module may include a conductive jacket electrically connected to a conductive panel.

BACKGROUND OF THE INVENTION

It is known in the power connector technology to provide an electrical connector for a power connection through the enclosure of equipment. The equipment is typically provided with a conductive shell into which all of the hardware is mounted. The power module is typically provided as a socket which is mounted to a cutout in the rear panel of the equipment. An electrical extension cord is then plugged into the socket where contacts of the cord electrically connect terminals in the power module socket to provide power to the equipment.

It is also known to common a conductive jacket of the module to the conductive panel of the desktop computer. This is shown in Applicant's SRB series modules.

It is also generally known in the connector art to common a shield of an electrical connector to a conductive panel, by way of contacts on the shield to increase the conductivity between the shield and the panel, see for example, U.S. Pat. No. 5,752,854. Such contacts however, may become plastically deformed or may provide only point contacts between the shield and the panel.

SUMMARY OF THE INVENTION

The objects have been accomplished by providing a power module comprising an insulating housing; electrical terminals positioned in the housing; a jacket surrounding at least a portion of the insulating housing; and a spring positioned intermediate the housing and the jacket, spring loading the housing and the jacket in opposite directions along a substantially common axis.

In another aspect, a power module comprises an insulating housing; electrical terminals positioned in the housing, comprised of at least one ground terminal; a jacket surrounding at least a portion of the insulating housing; and a spring positioned intermediate the housing and the jacket, the spring commoning the ground terminal to the jacket.

DETAILED DESCRIPTION

Figure 1:
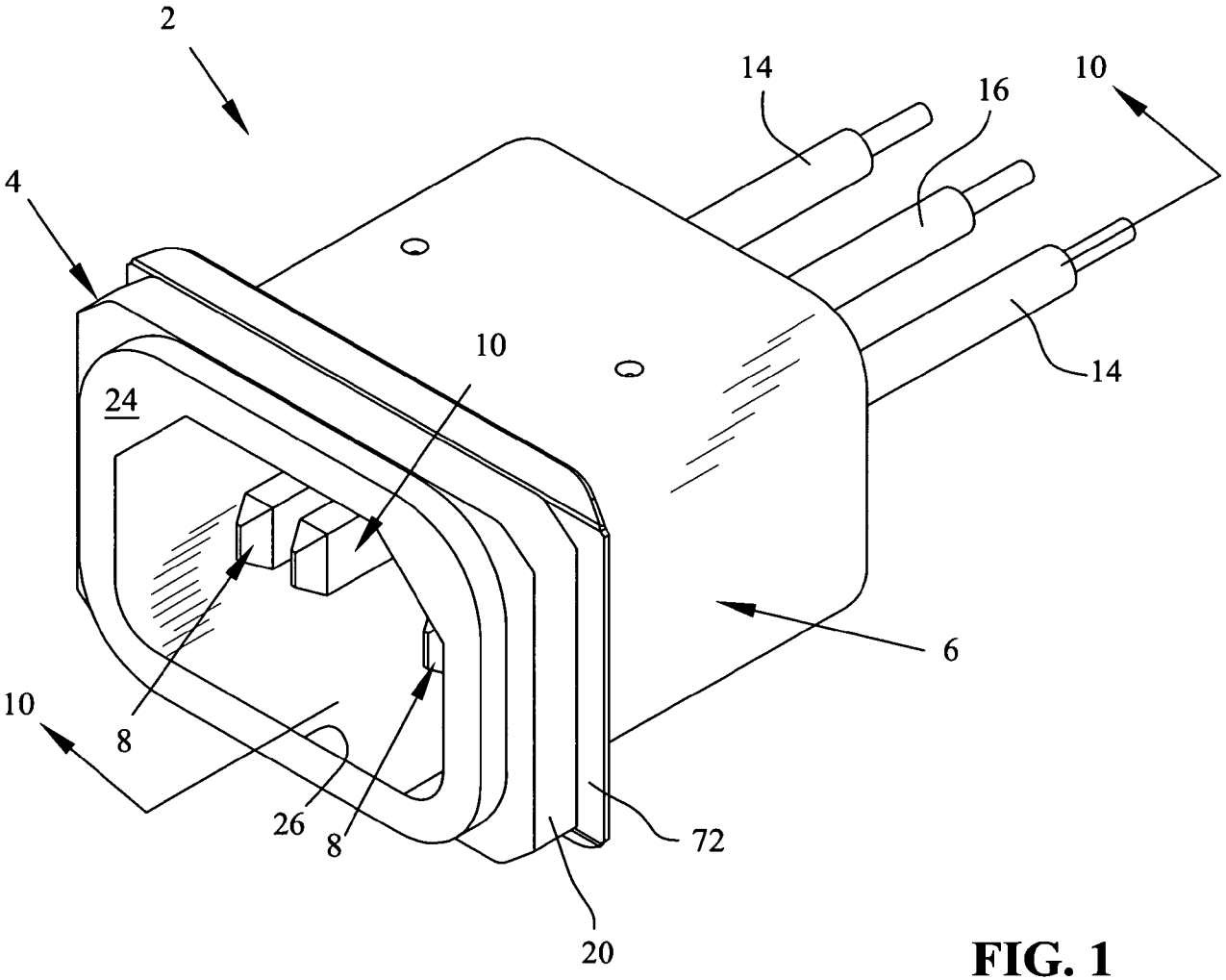
FIG. 1 is a front perspective view of the power module of the present invention.
Figure 2:
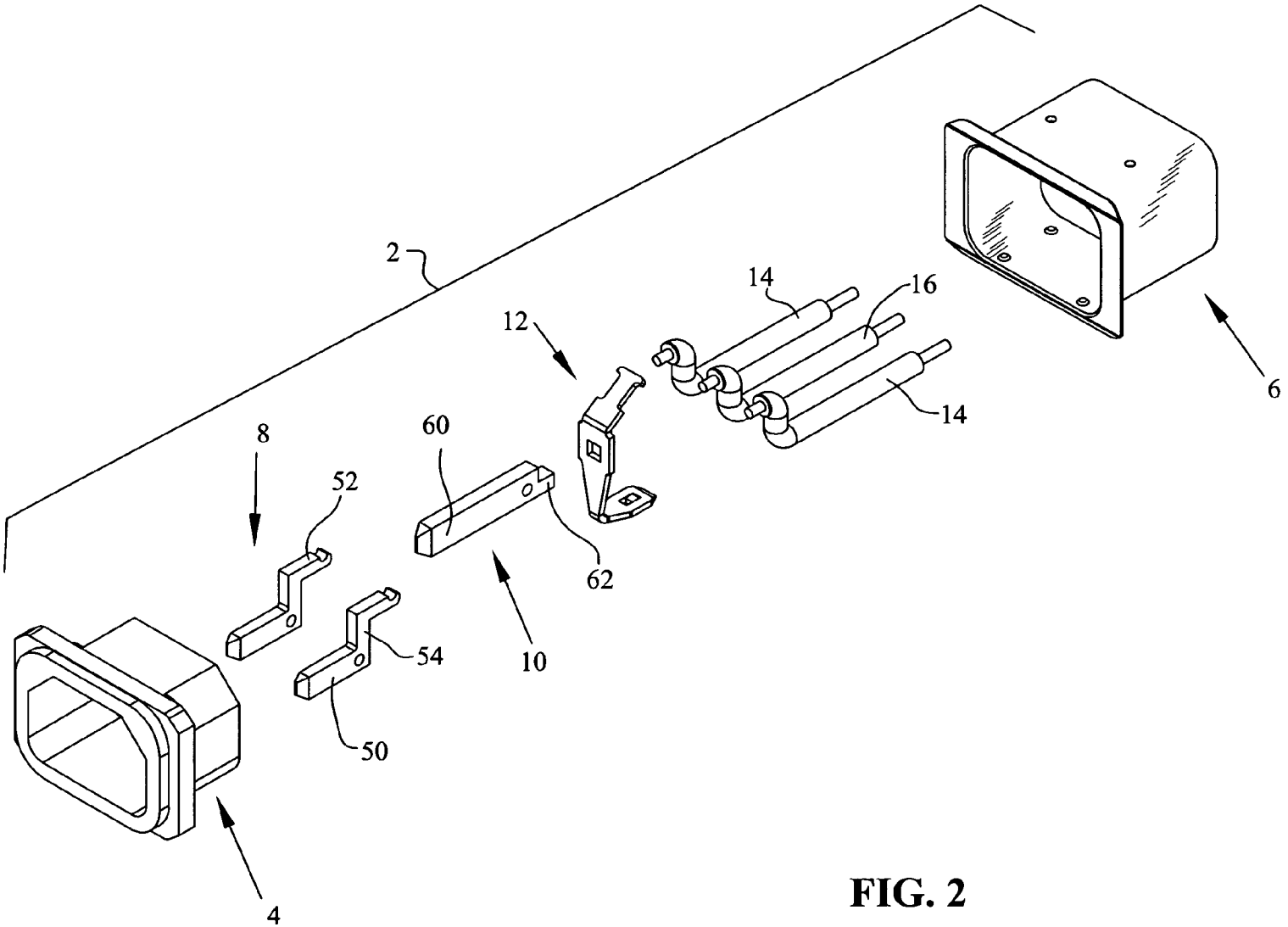
FIG. 2 is an exploded view of the module of FIG. 1.

With reference to FIGS. 1 and 2, power module 2 is generally comprised of an insulating housing 4, a jacket 6, power terminals 8, a ground terminal 10, a spring 12, where the power module 2 is connectable to power conductors 14, and to a ground conductor 16, where the power conductors and the ground conductor form a power cable. With the above elements generally described, each of the elements will now be described in greater detail.

Figure 4:
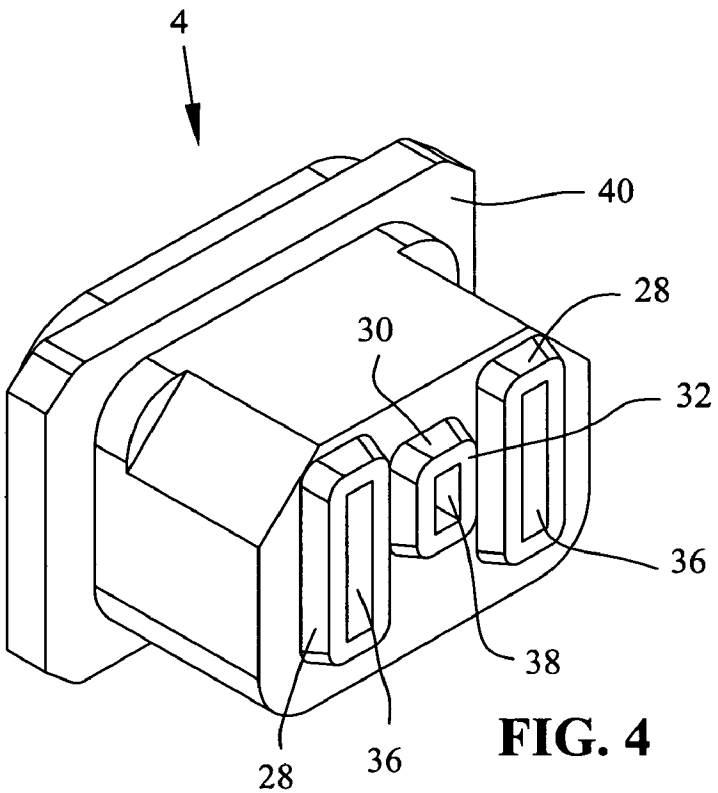
FIGS. 3 and 4 are front and rear perspective views respectively, of an insulating housing used in the power module.
Figure 3:
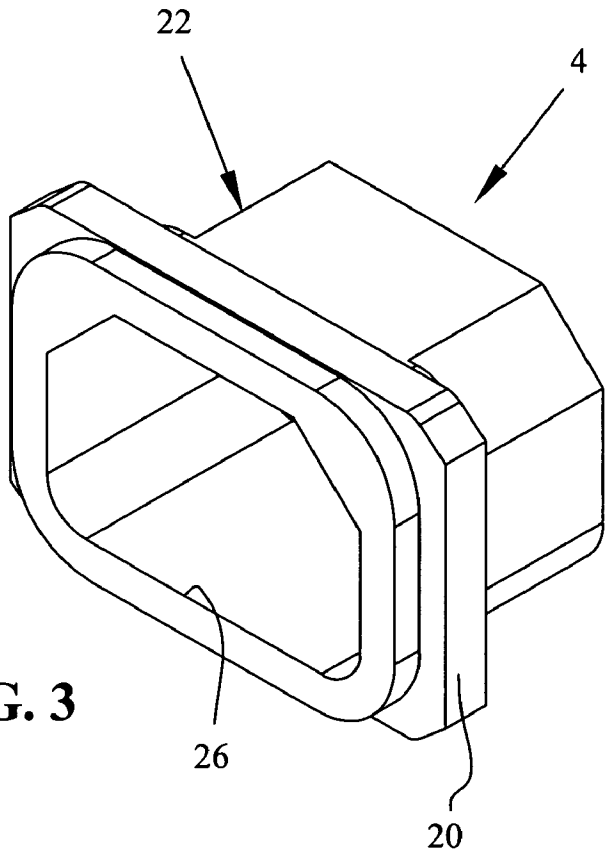

With reference now to FIGS. 1, 3 and 4, insulating housing 4 will be described in greater detail. Insulating housing 4 is comprised of an insulating flange 20 and an insulating body portion 22. As shown best in FIGS. 1 and 3, insulating housing 4 includes a front face 24 having a socket portion 26 extending therein which houses power terminals 8 and ground terminal 10. With respect to FIG. 4, the opposite end of body portion 22 shows bosses 28 and 30, where boss 30 provides a planar surface 32 providing an end face. With reference still to FIG. 4, bosses 28 circumscribe terminal receiving openings 36 for receipt of the power terminals 8. Boss 30 circumscribes terminal receiving opening 38 for receipt of ground terminal 10. Finally flange 20 defines a rearwardly facing surface 40 which, as will be described in greater detail later, is profiled for abutment against a panel.

With respect again to FIG. 2, power terminals 8 and ground terminal 10 will be described in greater detail. Power terminals 8 include a male tab portion 50, a wire-wrap portion 52 and an intermediate portion 54. Ground terminal 10 includes male tab portion 60 and a rear contact portion 62.

Figure 6:
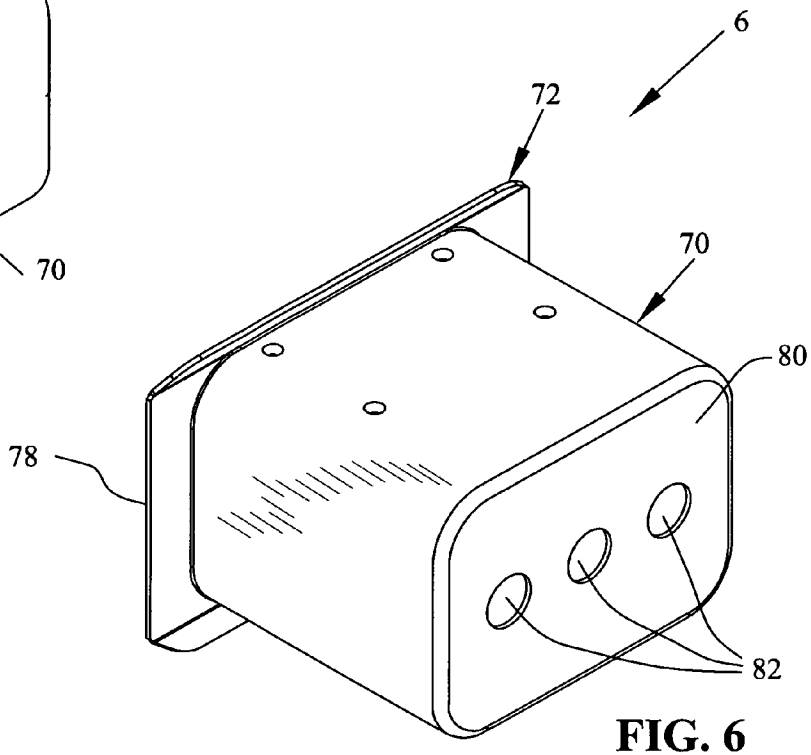
FIGS. 5 and 6 show front and rear view respectively, of the outer jacket for use with the power module of FIG. 1.
Figure 5:
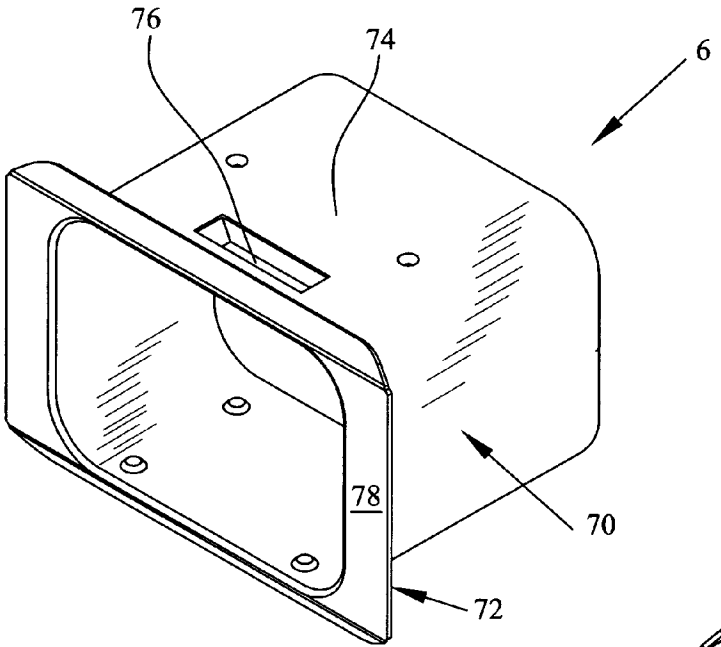
Figure 9:
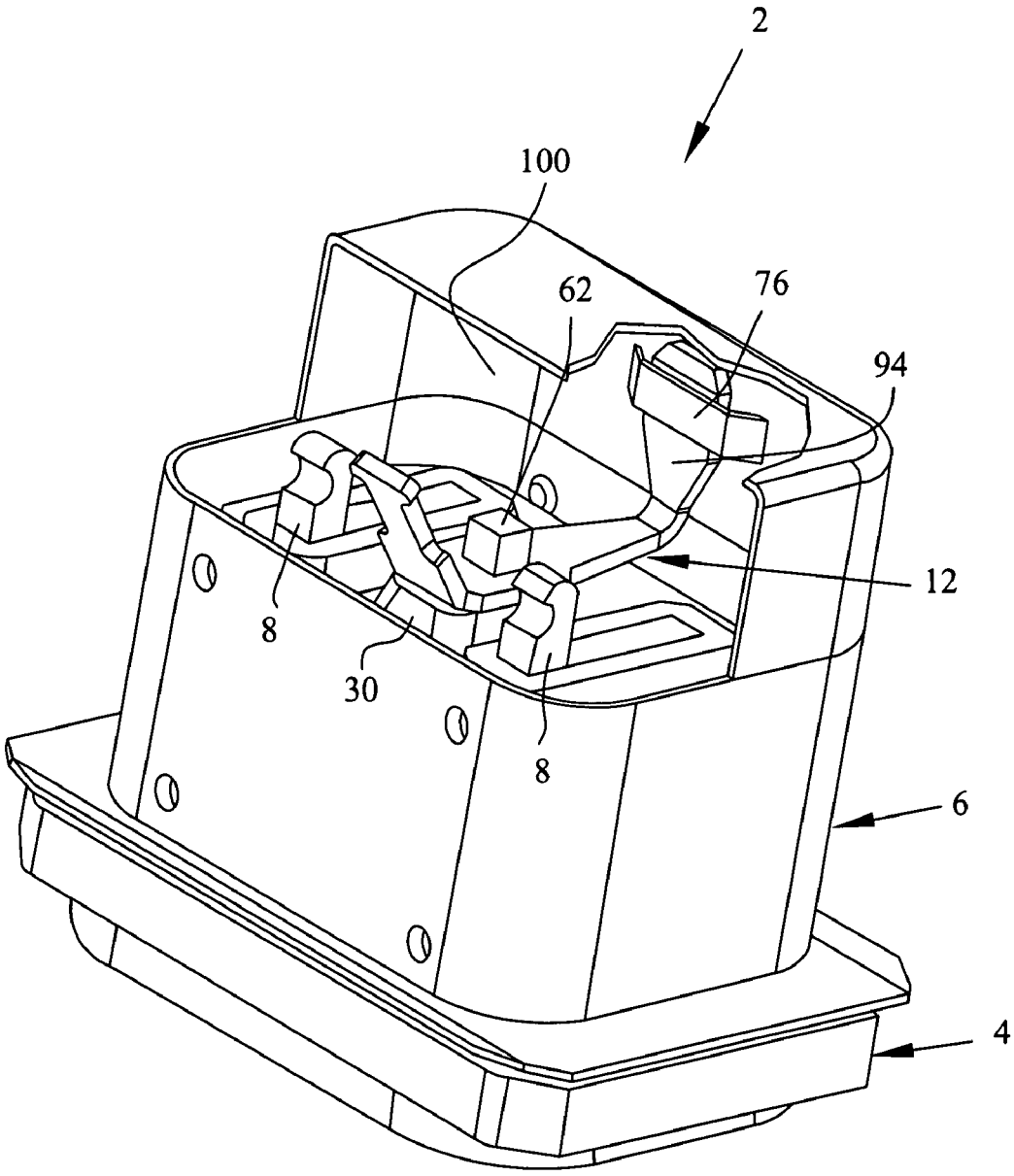
FIG. 9 shows a partially fragmented view of the power module of FIG. 1.

With respect now to FIGS. 5 and 6, jacket 6 will be described in greater detail. It should be appreciated that jacket 6 may be comprised of many materials, as further described herein. However as shown jacket 6 is conductive, and is generally comprised of a conductive body portion 70 and a conductive flange portion 72. As best shown in FIGS. 5 and 9, body portion 70 includes an outer peripheral wall 74 having an inwardly directed strap portion 76, which could be stamped from the jacket itself. Meanwhile, flange portion 72 includes a forwardly facing surface 78 which circumscribes a substantial portion of body portion 70 and is located opposite the rearwardly facing insulating surface 40, when in the position shown in FIG. 1. As shown in FIG. 6, jacket 6 also includes a rear wall 80 having apertures 82.

Figure 7:
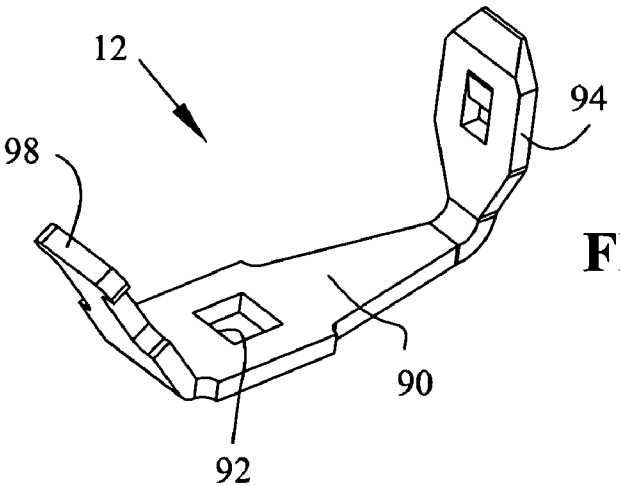
FIG. 7 shows a perspective view of the grounding spring.
Figure 8:
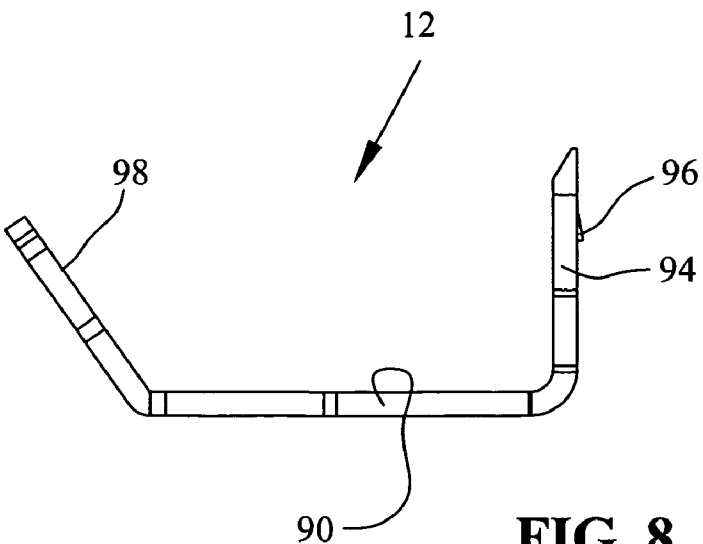
FIG. 8 shows a side plan view of the grounding spring shown in FIG. 7.

With reference now to FIGS. 7 and 8, spring 12 is shown to include a flat spring portion 90 having an aperture 92 therethrough, a spring leg 94 having a retention member 96 and a wire-wrap portion 98. Spring 12 could also be comprised of many different materials, but as shown is conductive. As such, spring 12 is a grounding spring, and is used in a dual sense; that is, spring 12 functions as a spring load feature, as well as a commoning mechanism to common the conductive jacket 6 and the ground terminal 10. With the above described components, the assembly of the connector will now be described.

Power terminals 8 are first inserted in their respective passageways 36 into the position shown in FIG. 9. Ground terminal 10 is then insertable into its respective opening 38, and as installed, rear contact portion extends beyond planar surface 32. Spring 12 may now be positioned such that aperture 92 (FIG. 7) overlies rear contact portion 62, and such that flat spring portion 90 (FIG. 7) lies substantially flat against planar surface 32 (FIG. 4). These two may now be soldered together to electrically and mechanically join the two. However, while solder is described herein, any number of connections may be made such as interference fit, welding, retention lances, and the like. The wire-wrap terminal portions 52 and 98 may now be connected to their associated insulated conductors in a known manner.

Jacket is now received over insulating body portion 22 whereupon spring leg 94 is receivable into strap portion 76 and whereby retention member 96 latches spring leg 94 in place. In the event that jacket 6 and spring 12 are both conductive, the strap portion 76 and spring leg 94 may also be soldered for further electrical and mechanical connection.

It should be appreciated that the insulating housing 4 and jacket 6 are connectable along a common axis, and that grounding spring 12 spring loads conductive flange 76 towards insulating flange 20 along the common axis. Thus, any movement of jacket 6 away from insulating body 4 attempts to "lift" grounding spring 12, and more particularly flat spring portion 90, off of its boss portion 30, and attempts to pull the two back together.

Figure 10:
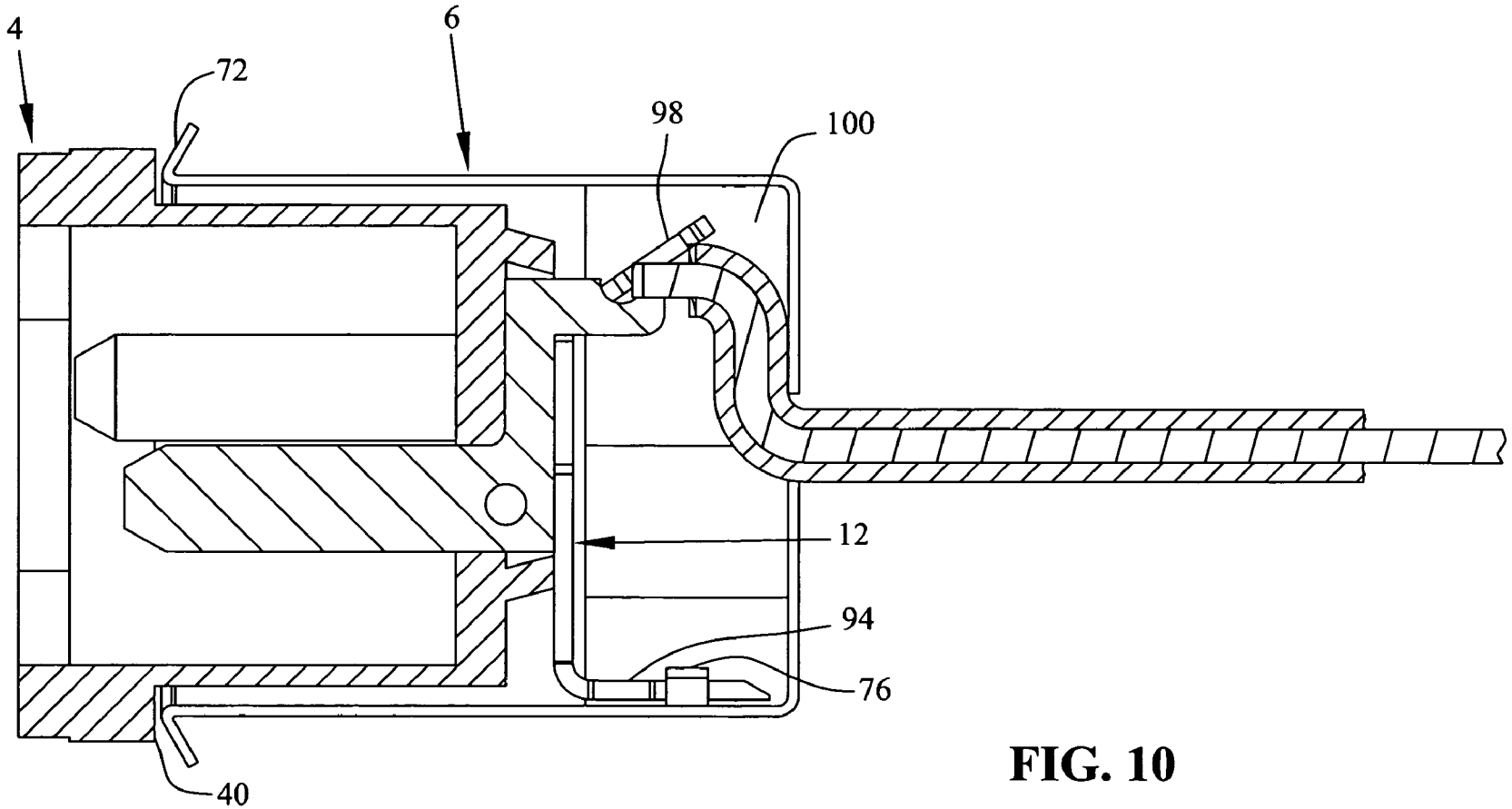
FIG. 10 is a cross-sectional view through lines 10-10 of FIG. 1.
Figure 11:
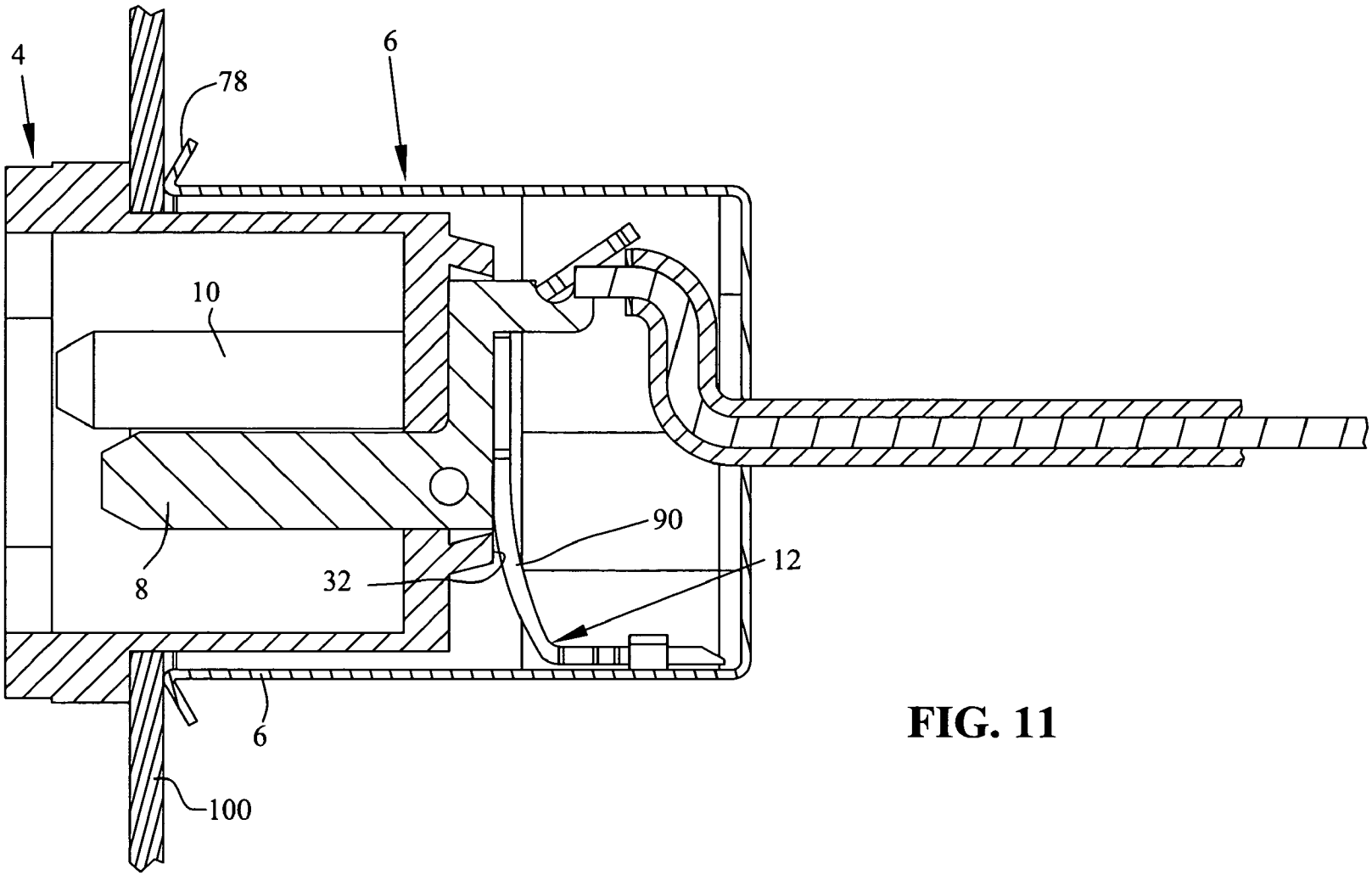
FIG. 11 shows a cross-sectional view similar to that of FIG. 10 where the power module is connected to a conductive panel.

For example, and as shown in FIG. 10, module 2 is shown prior to connection to a panel. In this condition, flange 72, and more particularly surface 78 (FIG. 5) is positioned proximate to rearwardly facing surface 40. However, when the jacket and the insulating housing 4, are positioned within a cutout of a panel 100 as shown in FIG. 11, flat spring portion 90 of spring 12 lifts off of planar surface 32 of boss 30. Thus, when the module 2 is assembled to a panel cutout, with a panel positioned between the surfaces 40, 78, flange 72 is spring loaded against its counterpart panel.

It should be appreciated that only one embodiment of the invention has been depicted and the power module could take on many forms. For example, the jacket 6 could alternatively be comprised of an insulating material such as plastic, or alternatively, could be plated plastic. Also, spring many be nonconductive and only used for the spring load feature. A nonconductive spring could be used with a conductive or nonconductive jacket, or a conductive spring could be used with either conductive or nonconductive jacket.

Furthermore, the grounding spring could be of any shape and/or configuration, and need not be positioned flat against the boss 30. Moreover, the jacket 6, grounding spring 12, and ground terminal 8, could be all stamped and/or formed from a single piece of common material.

What is claimed is:

1. A power module, comprising:

an insulating housing;

electrical terminals positioned in the housing;

a conductive jacket surrounding at least a portion of the insulating housing; and a spring positioned intermediate said housing and said conductive jacket to apply a spring force between said housing and said conductive jacket in opposite directions along a substantially common axis and electrically connected between one of the electrical terminals and the conductive jacket.

2. The power module of claim 1, wherein said housing includes a body portion and an insulating flange.

3. The power module of claim 2, wherein said insulating flange circumscribes a substantial portion of said body portion, and is profiled to mount to a panel.

4. The power module of claim 2, wherein said conductive jacket includes a conductive flange opposed to, and spring loaded against, said insulating flange.

5. The power module of claim 3, wherein said conductive jacket includes a conductive body portion and a conductive flange opposed to said insulating flange, said conductive flange circumscribing a substantial portion of said conductive body portion, and is profiled to mount to a panel.

6. The power module of claim 5, wherein said conductive body portion is profiled to overlap said insulating body portion along said substantially common axis.

7. The power module of claim 1, wherein one of said terminals is a ground terminal.

8. The power module of claim 7, wherein said spring commons said ground terminal to said conductive jacket.

9. The power module of claim 8, wherein said insulating housing further comprises an end face, and a portion of said ground terminal protrudes beyond said end face, said spring attached to said ground terminal portion protruding beyond said end face.

10. The power module of claim 8, wherein said conductive body portion extends beyond said end face creating an internal volume, said spring positioned within said internal volume.

11. The power module of claim 10, wherein said spring is comprised of a portion which lies substantially adjacent to said end face, and a spring leg which projects outwardly to contact an internal surface of said conductive body portion.

12. A power module, comprising:

an insulating housing;

electrical terminals positioned in the housing, comprised of at least one ground terminal; a conductive jacket surrounding at least a portion of the insulating housing and being movable relative to the housing; and a spring positioned intermediate said housing and said conductive jacket to apply spring force, said spring electrically connected between said ground terminal and said conductive jacket.

13. The power module of claim 12, wherein said spring loads said housing and said conductive jacket in opposite directions along a substantially common axis.

14. The power module of claim 13, wherein said housing includes an insulating body portion and an insulating flange.

15. The power module of claim 14, wherein said insulating flange circumscribes a substantial portion of said insulating body portion, and the insulating flange is profiled to mount the insulating body portion to a panel.

16. The power module of claim 14, wherein said conductive jacket includes a conductive flange opposed to, and spring loaded against, said insulating flange.

17. The power module of claim 14, wherein said conductive jacket includes a conductive body portion and a conductive flange opposed to said insulating flange, said conductive flange circumscribing a substantial portion of said conductive body portion, and is profiled to mount to a panel.

18. The power module of claim 17, wherein said conductive body portion is profiled to overlap said insulating body portion along said substantially common axis, and said insulating housing further comprises an end face, with a portion of said ground terminal protruding beyond said end face, said spring attached to said ground terminal portion protruding beyond said end face.

19. The power module of claim 18, wherein said conductive body portion extends beyond said end face creating an internal volume, said spring positioned within said internal volume.

20. The power module of claim 19, wherein said spring is comprised of a portion which lies substantially adjacent to said end face, and a spring leg which projects outwardly to contact an internal surface of said conductive body portion.

* * * * *